US005735669A

United States Patent [19]

Niemela

[11] Patent Number: 5,735,669

[45] Date of Patent: Apr. 7, 1998

[54] FLY WHEEL ASSEMBLY AND METHOD OF FORMING

[75] Inventor: Paul W. Niemela, Pickens, S.C.

[73] Assignee: Ryobi North America, Easley, S.C.

[21] Appl. No.: 688,718

[22] Filed: Jul. 31, 1996

[51] Int. Cl.[6] ..... D05B 81/00; F04D 29/30

[52] U.S. Cl. ..... 416/60; 416/183; 416/DIG. 3

[58] Field of Search ..... 416/60, 146 R, 416/244 R, DIG. 3, 241 R, 182, 183; 310/62, 63, 74, 153; 322/4; 280/217; 29/558; 74/445, 572

[56] References Cited

U.S. PATENT DOCUMENTS

| | | | |
|---|---|---|---|
| 1,963,855 | 6/1934 | Kratz . | |
| 2,041,555 | 5/1936 | Lee | 416/60 |
| 3,171,605 | 3/1965 | Knapp et al. . | |
| 3,811,361 | 5/1974 | Seely et al. . | |
| 3,838,301 | 9/1974 | Moriyama . | |
| 3,906,266 | 9/1975 | Cowman . | |
| 4,102,601 | 7/1978 | Bischoff | 416/60 |
| 4,115,030 | 9/1978 | Inagaki et al. | 416/DIG. 3 |
| 4,226,133 | 10/1980 | Hanke | 474/42 |
| 4,538,079 | 8/1985 | Nakayama et al. . | |
| 5,015,901 | 5/1991 | Phelon et al. . | |
| 5,375,637 | 12/1994 | Matsumoto et al. . | |
| 5,431,612 | 7/1995 | Holden . | |

FOREIGN PATENT DOCUMENTS

| | | | |
|---|---|---|---|
| 0244634 | 9/1992 | Japan | 74/572 |

*Primary Examiner*—Christopher Verdier
*Attorney, Agent, or Firm*—Brooks & Kushman P.C.

[57] ABSTRACT

A combination flywheel, fan and pulley assembly is provided having a three piece construction, namely a central hub, at least one metal disk, and a stamped sheet metal centrifugal fan. The central hub is provided with a first circumferential surface for supporting at least one metal disk and a centrifugal fan. The hub is further provided with a bore extending at least partially through the central hub to enable the hub to be mounted on the motor shaft. The centrifugal fan has a plurality of circumferentially spaced apart radial extending blades which project axially from a generally flat face. The fan and at least one disk are securely mounted to the hub providing an integral unit. The construction method enables a wide variety of flywheel weights and hub geometries to be simply fabricated with minimal expense and production delay.

7 Claims, 2 Drawing Sheets

FLY WHEEL ASSEMBLY AND METHOD OF FORMING

TECHNICAL FIELD

This invention relates to flywheel assemblies used in conjunction with electric motors and, more particularly, to a combination flywheel, fan and pulley member and methods for forming same.

BACKGROUND OF THE INVENTION

Electric motors are frequently provided with fans mounted for rotation with the armature shaft in order to cool the motor armature field. One relatively common application of a flywheel mounted on the motor shaft is when a flywheel and fan are combined to integrally form an assembly which provides the necessary inertia and cools the motor while minimizing the number of motor parts.

In several commercially available exercise machines, a motor is provided with a combination flywheel, fan and output pulley as illustrated in FIGS. 1 and 2. A combination flywheel, fan and pulley member 10 is formed of an iron cast which is machined and balanced. Member 10 is provided with a central hub 12 having a central bore 14 for mounting on the end of a motor shaft (not shown). Hub 12 also is provided with a pulley member 16 for driving a conventional grooved belt. The flywheel portion of member 10 is formed by an annular cast iron disk 18 extending about hub 12 having a series of fan blades 20 axially projecting therefrom.

The prior art combination flywheel, fan and pulley member 10 is expensive to manufacture and has a relatively long lead time between the placement of the order and the completion of the finished parts. It is therefore necessary to maintain inventories of combination flywheel, fan and pulley members of various weights, pulley diameters and belt types in order to meet production requirements for a multi-product manufacturing operation.

Therefore, it is an object of the present invention to minimize the manufacturing lead time required to manufacture a combination flywheel, fan and pulley assembly.

It is yet another object of the present invention to facilitate the manufacture of small batches of combination flywheel, fan and pulley assemblies economically.

It is yet another object of the present invention to provide a combination flywheel, fan and pulley assembly having a highly efficient fan member.

SUMMARY OF THE INVENTION

Accordingly, a combination flywheel, fan and pulley assembly of the present invention is provided which has a three-piece construction including a central hub, at least one metal disk and a stamped sheet metal centrifugal fan. The central hub is provided with a first circumferential surface for supporting at least one disk and the centrifugal fan and an axially spaced apart second circumferential surface which defines a pulley member. A bore extends at least partially through the central hub to enable the hub to be mounted upon a motor shaft. The centrifugal fan has a plurality of circumferentially spaced apart radially extending blades which project axially from a generally flat axial face. The fan and at least one disk are securely mounted adjacent one another on the first circumferential surface of the central hub. The components are affixed relative to one another to prevent axial and rotational relative movement therebetween. The thickness and number of metal disks may be varied to achieve desired flywheel weight. The diameter of the pulley and the specific pulley type may be varied by altering the central hub machining process, enabling a wide variety of combination flywheel, fan and pulley assemblies to be fabricated from various combinations of components. This facilitates the cost efficient manufacture of a high performance combination flywheel, fan and pulley member.

These and other features and advantages of the invention will be readily apparent from the following detailed description of the preferred embodiment.

BEST MODE FOR CARRYING OUT THE INVENTION

Figure 1:
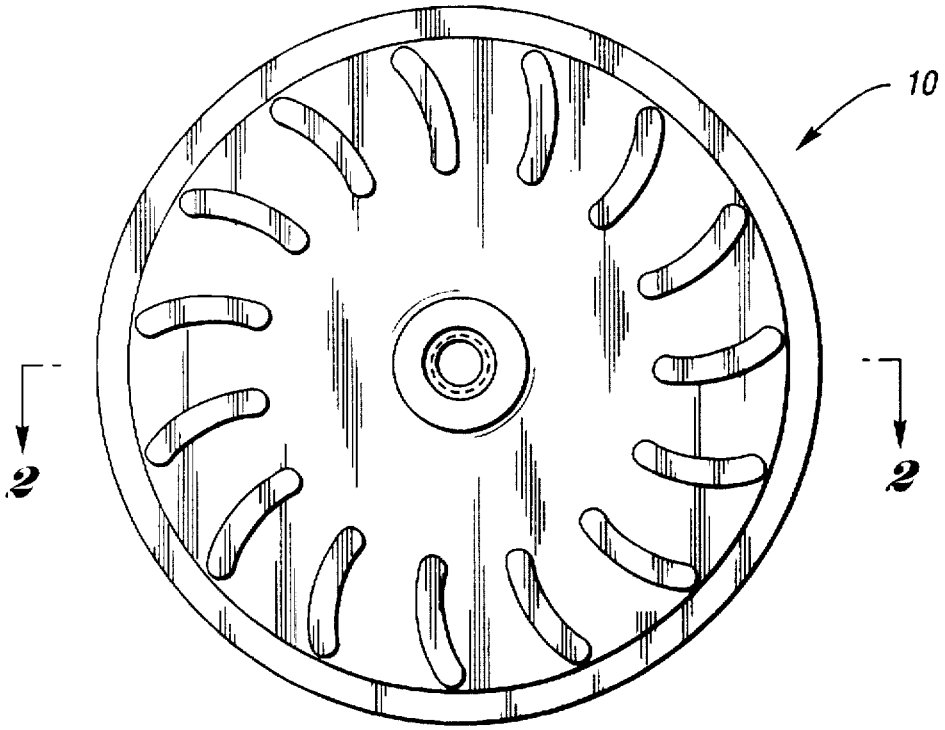
Fig. 1 (PRIOR ART)
FIG. 1 is an axial end view of a combination flywheel, fan and pulley member utilizing the prior art.
Figure 2:
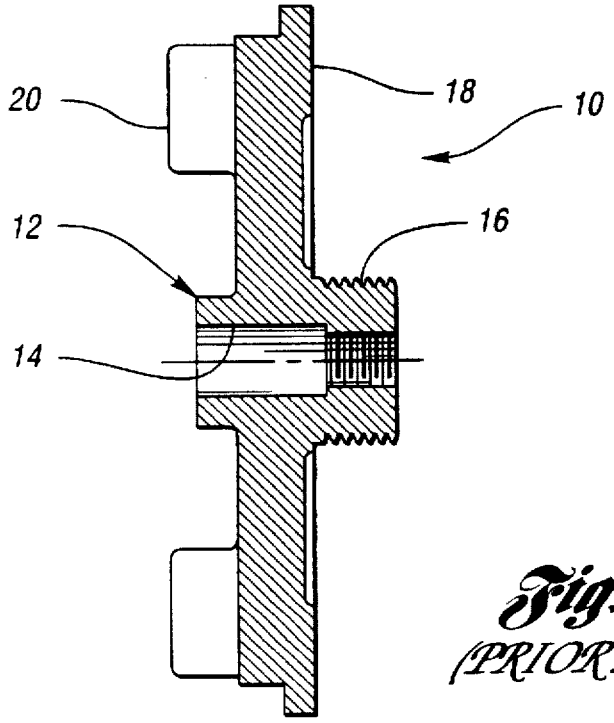
Fig. 2 (PRIOR ART)
FIG. 2 is a cross-sectional side elevational view taken along line 2—2 of FIG. 1.
Figure 3:
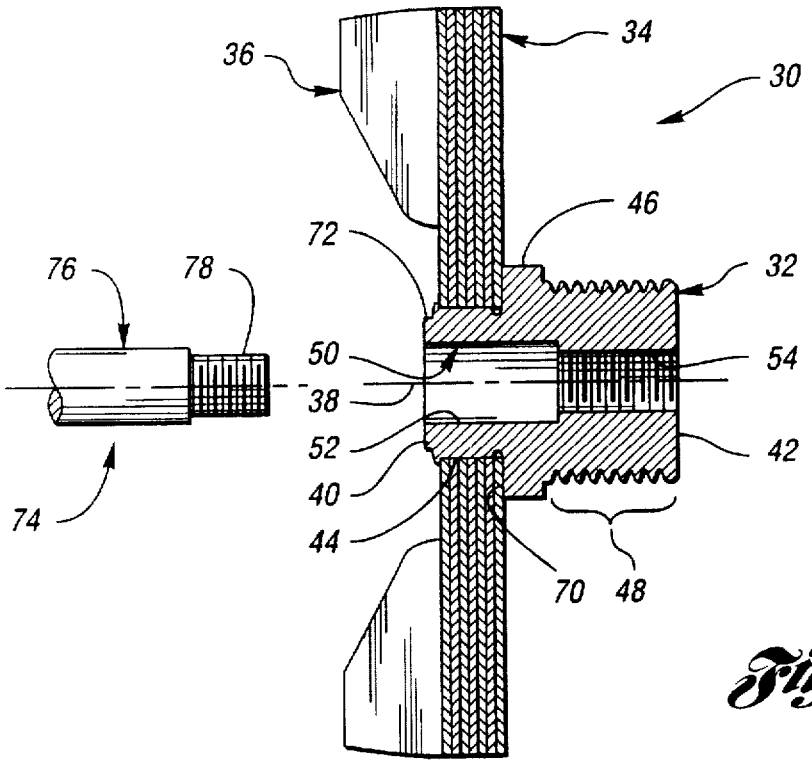
FIG. 3 is a cross-sectional side elevational view of the combination flywheel, fan and pulley member constructed in accordance with the present invention.
Figure 4:
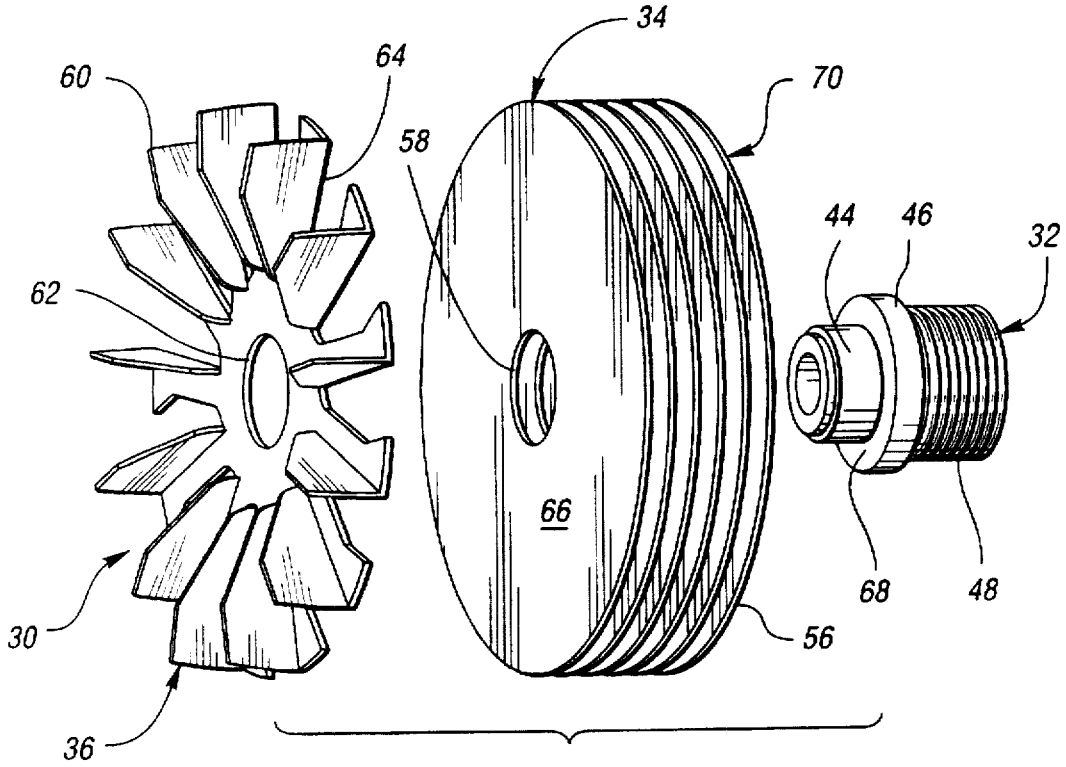
FIG. 4 is an exploded perspective view of the combination flywheel, fan and pulley member illustrated in FIG. 3.

Referring to FIGS. 3 and 4, the combination flywheel, fan and pulley member is generally indicated by reference numeral 30. Member 30 is made up of three primary components, a central hub 32, at least one metal disk 34 and a centrifugal fan 36 integrally connected together to form a single unit. Central hub 32 extends along central axis 38 and has a pair of axially spaced apart first and second ends 40 and 42. Formed on the outer periphery of the central hub between ends 40 and 42 are a first circumferential surface 44, an annular flange 46 and a second circumferential surface 48. Second circumferential surface 48 is machined to define a pulley surface which in the embodiment illustrated is formed above a series of annular grooves sized to cooperate with a ribbed belt (not shown).

Central hub 32 is further provided with a central bore 50 which extends at least partially through central hub 32. In the preferred embodiment illustrated, central bore 50 extends all the way through central hub 32 having a smooth circular cylindrical portion 52 and a relatively smaller diameter threaded portion 54. Preferably, central hub 32 is turned on a lathe or a computerized turning station from a length of bar stock so that the geometry of the central hub can be quickly varied by making a program selection, which, for example, would vary the diameter of the second circumferential surface 48 or alter the pulley configuration to accommodate different belt designs. The inside diameter of central bore 50 can also be varied to accommodate a different motor shaft design.

In the preferred embodiment illustrated, at least one disk 34 is provided by a stacked series of six identical plates stamped from thin sheet metal stock. By using relatively thin sheet metal stock having a thickness of less than 0.100 inches and preferably between 0.040–0.080 inches, low cost stamping dies can be utilized, part spacing and the resulting scrap can be minimized and relatively small variations in flywheel weight can be achieved by varying the number of plates utilized in the assembly. Disks 34 are each provided with a generally circular outer peripheral edge 56 and a central bore 58 sized to cooperate with first circumferential surface 44 on central hub 32. Ideally, the diameter of central bore 58 will be sized relative to the diameter of the first circumferential surface 44 to achieve a slight interference fit.

Centrifugal fan 36, best shown in FIG. 4, is stamped from flat steel stock and has a series of circumferentially spaced apart blades 60 extending radially outward from central bore 62. It should be appreciated that while in the embodiment illustrated blades 60 are radial, curved or inclined blades can similarly be formed to achieve the desired fan characteristics provided that the blades have a significant radial component, which will cause air to move circumferentially outward away from the central axis 38 as the fan is rotated.

As fan 36 is stamped from a sheet of flat stock, blades 60 are folded up in a common direction maintaining a flat axial face 64 on one axial side of the fan. The flat axial face 64 of fan 36 abuts in face-to-face relation with a flat side 66 of the end disk in the plurality of disks 34 forming the disk stack illustrated.

Annular flange 46 extending about the central hub 32 is provided with a face surface 68 which is perpendicular to central axis 38. Face surface 68 abuts with a flat side 70 of disk 34 as illustrated to maintain the disks in perpendicular alignment with the central axis.

Preferably, with disk 34 and fan 36 installed upon central hub 32, the components are permanently secured together by staking the first end 40 of central hub 32. Stakes 72 prevent any axial or relative rotational movement between the central hub 32, the plurality of disks 34, and fan 36. Circumferential surface 74 of motor shaft 76 fits within hub 32 of flywheel, fan and pulley member 30 cooperating with central bore 50. Motor shaft 76 is further preferably provided with a threaded end 78 corresponding to hub threaded portion 54.

The method of forming a combination flywheel fan and pulley member for attachment to a motor shaft is likewise unique. The method comprises the following steps:

A central hub is turned from bar stock with the hub having its central axis and a pair of spaced apart ends. The hub is further provided with a first circumferential surface and a second circumferential surface spaced axially from the first circumferential surface for providing a pulley. A central bore extends at least partially through the hub to facilitate cooperation with a motor shaft. A threaded internal bore extends at least partially through the central hub for cooperation with a corresponding threaded portion on the motor shaft.

A centrifugal fan is stamped from sheet metal stock to form a plurality of circumferentially spaced apart radially extending blades which project axially from a generally flat axial face. The centrifugal fan is further provided with a central aperture sized to cooperate with the central hub first circumferential surface.

A plurality of metal disks are stamped from sheet metal stock with each disk having a generally circular outer periphery and a central aperture sized to cooperate with the central hub first circumferential surface.

The centrifugal fan and the plurality of disks are installed upon the first circumferential surface of the central hub. A sufficient number of disks are installed in order to achieve the desired finished assembly weight.

Finally, the centrifugal fan and plurality of disks are attached securely to the central hub in order to limit relative axial movement and rotation inbetween.

It is to be understood, of course, that while the forms of the present invention described above constitute the preferred embodiments of the present invention, the preceding description is not intended to illustrate all possible forms thereof. It is also to be understood that the words used are words of description, rather than limitation, and that various changes may be made without departing from the spirit and scope of the present invention, which should be construed according to the following claims.

What is claimed is:

1. A combination flywheel, fan and pulley member for attachment to a motor shaft, the member comprising:

a central hub extending along a central axis having a pair of spaced apart ends, a first circumferential surface, a second circumferential surface defining a pulley which is axially spaced from the first circumferential surface, and a central bore extending at least partially through the central hub for cooperation with the motor shaft;

at least one disk formed of a sheet metal stock, the at least one disk having a generally circular outer periphery, and a central aperture sized to cooperate with the central hub first circumferential surface; and a stamped sheen metal centrifugal fan having a plurality of circumferentially spaced apart, radially extending blades projecting axially from a generally flat axial face and a central aperture sized to cooperate with the central hub first circumferential surface;

wherein the fan and the at least one disk are securely mounted adjacent one another on the central hub first circumferential surface with the fan flat axial face abutting a flat side of at least one disk, and are permanently affixed to the central hub by staking an axial end of the hub adjacent the first circumferential surface.

2. The combination flywheel, fan and pulley member of claim 1 wherein the central hub is further provided with an annular flange interposed between the first circumferential surface and the second circumferential surface for defining a shoulder to abut the at least one disk and to align the at least one disk generally perpendicular to the central axis.

3. The combination flywheel, fan and pulley member of claim 1 wherein the at least one disk comprises a plurality of substantially identical metal disks coaxially aligned in side-to-side arrangement.

4. The combination flywheel, fan and pulley member of claim 3 wherein the metal disks each have a thickness of less than 0.100 inches.

5. The combination flywheel, fan and pulley member of claim 3 wherein the metal disks each have a thickness between 0.040 and 0.080 inches.

6. A method of forming a combination flywheel, fan and pulley member for attachment to a motor shaft, the method comprising the steps of:

turning a central hub from bar stock, wherein the hub has a central axis having a pair of spaced apart ends, a first circumferential surface, a second circumferential surface defining a pulley which is axially spaced from the first circumferential surface, and a central bore extending at least partially through the central hub for cooperation with the motor shaft;

stamping a centrifugal fan from sheet metal stock having a plurality of circumferentially spaced apart, radially extending blades projecting axially from a generally flat axial face and a central aperture sized to cooperate with the central hub first circumferential surface;

stamping a plurality of metal disks from sheet metal stock, each disk having a generally circular outer periphery and a central aperture sized to cooperate with the central hub first circumferential surface;

installing the plurality of disks on the first circumferential surface of the central hub sufficient to achieve a desired finished assembly weight;

installing the centrifugal fan upon the first circumferential surface of the central hub; and attaching at least one of the axially spaced apart ends of the central hub to the centrifugal fan, to securely retain the centrifugal fan and the plurality of disks on the central hub, limiting axial movement and relative rotation therebetween.

7. The method of claim 6 further comprising the step of threading an internal bore extending at least partially through the central hub for cooperation with a corresponding threaded portion on the motor shaft.

* * * * *